US006938931B1

(12) United States Patent
Davis

(10) Patent No.: US 6,938,931 B1
(45) Date of Patent: Sep. 6, 2005

(54) TAKE-OUT MENU STORAGE FOLDER

(75) Inventor: Glenn Davis, Highland Park, IL (US)

(73) Assignee: Tablecraft Products Company, Gurnee, IL (US)

( * ) Notice: Subject to any disclaimer, the term of this patent is extended or adjusted under 35 U.S.C. 154(b) by 8 days.

(21) Appl. No.: 10/242,245

(22) Filed: Sep. 12, 2002

(51) Int. Cl.[7] ..... B42D 3/00

(52) U.S. Cl. ..... 281/31; 40/359; 281/3.1; 281/15.1; 402/73; D19/26

(58) Field of Search ..... 281/3.1, 15.1, 281/29, 31, 36, 37, 38, 45, 51; 40/359; D19/26, D19/27

(56) References Cited

U.S. PATENT DOCUMENTS 4,336,754 A * 6/1982 Loeb ..... 101/127
4,907,823 A * 3/1990 Windish ..... 281/31
D314,977 S * 2/1991 Wyant ..... D19/27
5,059,052 A * 10/1991 Casper ..... 402/80 R
5,487,566 A * 1/1996 Hedge, Jr. ..... 283/56
5,610,770 A * 3/1997 Galiani ..... 359/807
5,671,951 A * 9/1997 Palmiter et al. ..... 281/31
5,951,190 A * 9/1999 Wilson ..... 402/73
D420,385 S * 2/2000 Inbert ..... D19/27
6,050,214 A * 4/2000 OKeefe ..... 116/323
6,244,627 B1 * 6/2001 Wolff et al. ..... 281/29
6,305,714 B1 * 10/2001 Rossetto et al. ..... 281/37

* cited by examiner

*Primary Examiner*—Monica S. Carter
(74) *Attorney, Agent, or Firm*—Pearne & Gordon LLP

(57) ABSTRACT

An organizer for take-out menus comprises a plastic folder of a size conveniently held in one hand and stored in a kitchen drawer or like area. The folder is made of multiple layers that provide pockets for permanent insert cards that stiffen the folder and, optionally, provide decorative and/or informational data, and pockets for receiving take-out menus of various sizes and configurations in a manner that displays such menus for quick identification, retrieval, reference and return.

4 Claims, 2 Drawing Sheets

FIG. 1
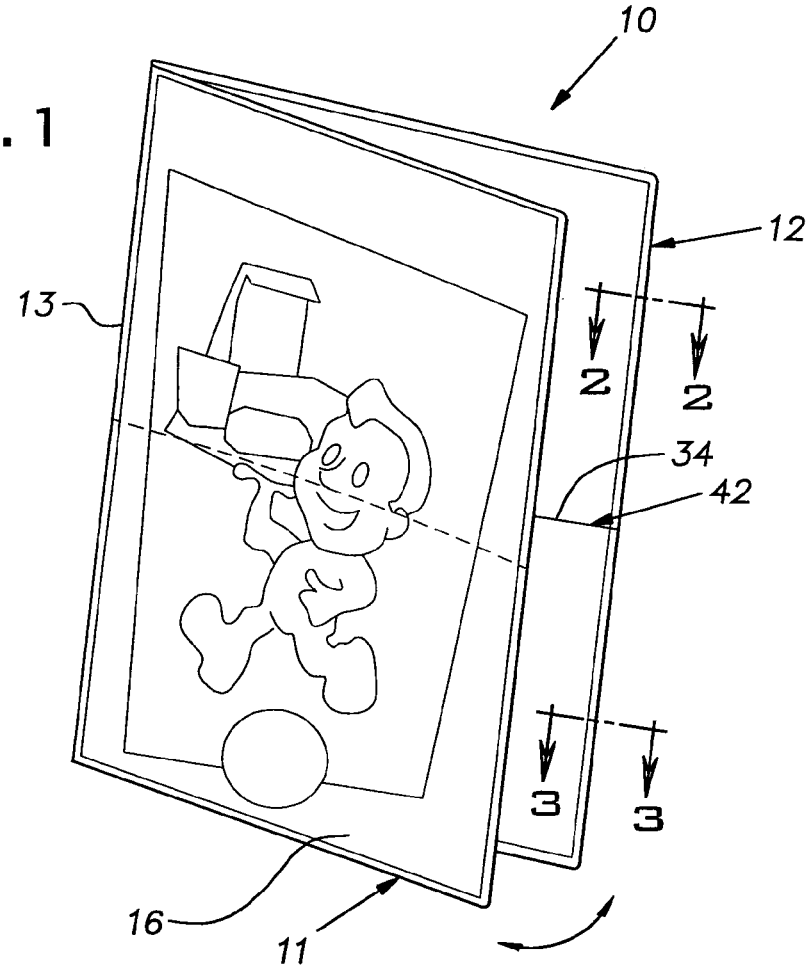
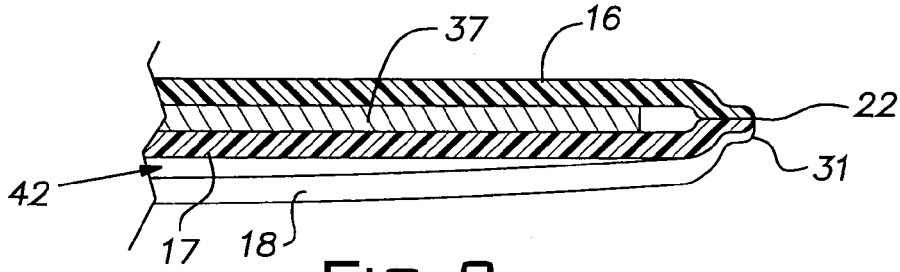
FIG. 2
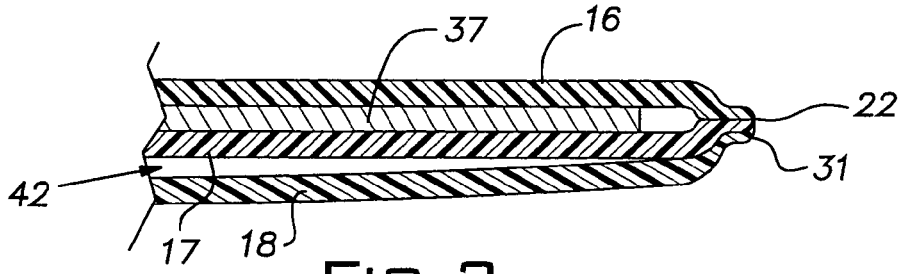
FIG. 3

TAKE-OUT MENU STORAGE FOLDER

BACKGROUND OF THE INVENTION

The invention relates to devices for storing, organizing and presenting food take-out menus and a method of use of the same.

PRIOR ART

Various factors in the lifestyles of people have lead to a decrease in traditional home-cooked meals and an increase in the popularity of commercially prepared food such as "take-out" meals. Take-out meals, typically, are purchased at local restaurants, fast-food stores, food supermarkets, specialty food shops, and similar establishments. Such establishments publish take-out menus for their patrons that reflect food selection, price, availability, store hours, and like information with the expectation that such menus will be retained by the patron at his or her residence for future reference. Such take-out menus come in a variety of shapes and sizes but, most commonly, are printed on paper sheets or leaflets.

There exists a need on the part of consumers or patrons of take-out food establishments for a way of organizing, storing and retrieving take-out menus in a manner that is inexpensive, convenient and versatile.

SUMMARY OF THE INVENTION

The invention provides a take-out menu organizer in the form of handy folder. The folder is capable of storing and displaying take-out menus for quick retrieval, reference and, ultimately, return. The disclosed construction of the organizer is economical to produce and distribute. From a user's standpoint, the organizer is convenient to hold in one hand and is sized to fit in most common storage areas found in a residence, such as in a kitchen drawer.

The disclosed organizer holds numerous take-out menus at least in partial view. A selected menu is easily identified and retrieved from the folder with minimum effort and time. Moreover, the organizer readily accommodates menus of different size and construction.

In its preferred form, the organizer comprises flexible plastic sheets in the form of a two-leaf folder that, when closed, is essentially flat. Preferably, the leafs are mirror images of each other and are joined at an intermediate flexible fold line. Each leaf includes three layers arranged to form two pockets. One of the pockets has substantially the full size of the leaf and, ideally, receives a decorative stiffening sheet. The other pocket is adapted to receive and store take-out menus.

More specifically, the menu organizer folder can be fabricated from vinyl sheets heat welded at certain edges to form the closed sides of the pockets. The stiffening sheets can be inserted into the large pockets to thereby increase the rigidity of the vinyl material. The vinyl sheets are preferably clear so that the stiffening sheets can include printed indicia such as a decorative design or informative text. The pockets for receiving the menus are preferably formed of clear vinyl so as to reveal as much as possible of the menus contained in them so as to enable them to be seen and identified at a quick glance.

BRIEF DESCRIPTION OF THE DRAWINGS

FIG. 1 is a perspective view of a take-out menu organizer constructed in accordance with the invention;

FIG. 2 is a fragmentary cross-sectional view of a leaf of the organizer taken in the plane 2—2 indicated in FIG. 1;

FIG. 3 is a fragmentary cross-sectional view of a leaf of the organizer taken in the plane 3—3 indicated in FIG. 1;

DESCRIPTION OF THE PREFERRED EMBODIMENT

Figure 4:
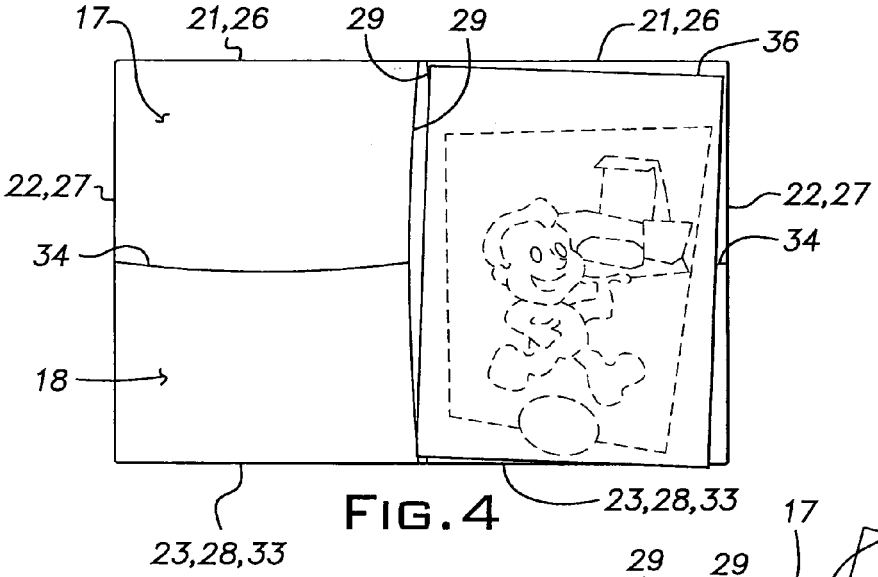
FIG. 4 is an elevational view showing the organizer in an open position with an insert or stiffening sheet being assembled into a full pocket in one of the leafs.

Referring now to the figures, a take-out menu organizer 10 in accordance with the invention is provided in the form of a folder with two substantially flat leafs 11, 12. The leafs 11, 12 are joined by a fold line 13 and that are mirror images of one another and are symmetrical about the fold line. Each leaf, 11, 12, is rectangular and, as illustrated, has a height greater than its width. By way of example, the leafs can be about 10" tall and 7" wide. These dimensions can be varied somewhat but preferably not more than ±1" or 2" so that the organizer is large enough to receive typical take-out menus without having to fold the menus multiple times and not so large as to be difficult to hold in one hand.

Each leaf 11, 12 comprises three rectangular layers or sheets: an outer layer 16, an intermediate or middle layer 17, and an inner layer 18. The outer layers 16, i.e. the layers directly visible when the folder organizer 10 is closed (the organizer is nearly closed in FIG. 1), can be made of a single or one-piece sheet folded at the fold line 13.

The intermediate layer 17 has a width slightly less than the width of the outer layer measured to the fold line 13 and a height equal to that of the outer layer 16. The inner layer 18 has a width equal to the width of the intermediate layer 17 and has a height about equal to one-half the height of the intermediate and outer layers 17, 16. Outer edges 21, 22 and 23 of the intermediate layer 17 are coincident with and are welded or otherwise permanently secured to corresponding edges 26, 27 and 28 of the outer sheet. An inner edge 29 of the intermediate sheet 17 is spaced slightly from the fold line 13. Similarly, side edges 31, 32 and a lower edge 33 of the inner sheet 18 are registered or coincident with the side and lower edges 22, 29 and 23 of the intermediate sheet 17 (as well as a lower part of the side edge 27 and the lower edge 28 of the outer sheet 16). An upper edge of the inner layer or sheet 18 is designated by the numeral 34. The registered edges 31-33 of the inner sheet 18 are welded or otherwise permanently secured to the underlying edges 22, 23 and 29 of the intermediate layer 17. Note that the vertical inner edge 32 of the inner sheet 18 is secured onto the vertical inner edge 29 of the intermediate sheet 17 while this edge of the intermediate sheet remains free of the outer sheet 16. Similarly, the upper edge 34 of the inner sheet 18 remains free of the intermediate layer 17. From the foregoing description, it will be understood that the intermediate layer 17 and outer layer 16 forms a large pocket therebetween with the entrance to the pocket existing at the free edge 29 of the intermediate sheet 17 (on each leaf 11). Similarly, the inner sheet 18 and intermediate sheet 17 form a pocket therebetween with the entrance to this pocket existing at the upper edge 34 of the inner layer or sheet 18. For reasons that will be apparent from the discussion below, the layers 16–18 of the folder organizer 10 are advantageously made of suitable flexible clear vinyl of a thickness, for example, of about 0.012".

Insert sheets 36, 37 are disposed in the large pockets on each leaf 11, 12 between the intermediate layer 17 and outer layer 16. In FIG. 4, the insert sheet 36 is shown being inserted into the pocket on the leaf 11 at the left. Each of the insert sheets can be formed of paper-based cardstock and can have a thickness of, for example, 0.010". The sheets 36, 37 can have decorative or informational indicia or text printed on one or both of their faces. The sheets 36, 37 are about the same size as the pockets.

Figure 5:
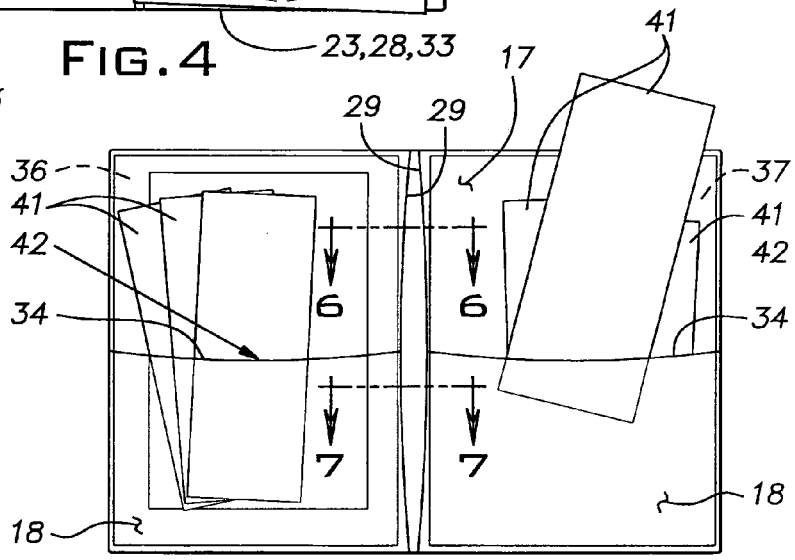
FIG. 5 is an elevational view of the organizer in an open position similar to FIG. 4, but with numerous take-out menus stored in the pockets of both leafs.
Figure 6:
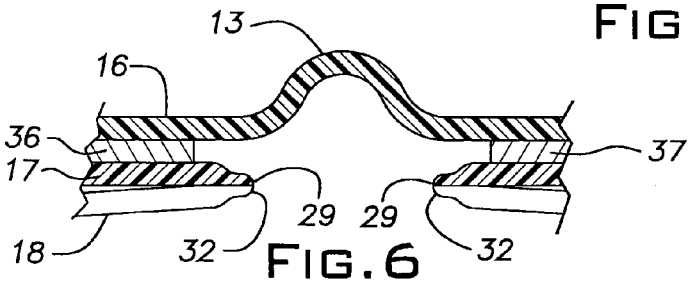
FIG. 6 is a cross-sectional view of a fold area joining the two leafs of the organizer at a plane indicated by the numerals 6—6 in FIG. 5, such plane being above the take-out menu storage pockets.
Figure 7:
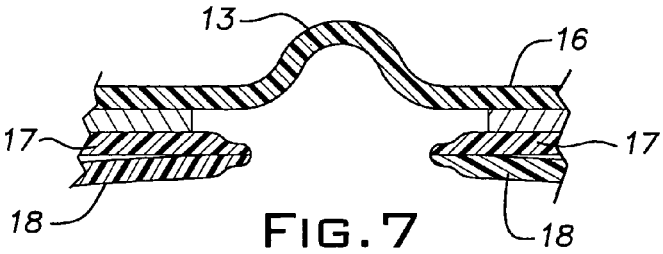
FIG. 7 is a view similar to FIG. 6 taken at a lower plane indicated by the numerals 7—7 in FIG. 5 and passing through the take-out menu storage pockets.

FIG. 5 illustrates the use of the organizer 10. Take-out menus 41 are inserted in the pockets formed by the inner sheets 18 and intermediate sheets 17. The take-out menus 41, typically, vary in size, paper weight (thickness), number of pages, color and so forth. It will be appreciated, that the pockets, designated 42, accommodate most normal formats of such take-out menus. Oversized take-out menus 41 can be folded to fit in the pockets 42. The take-out menus 41 can be fanned to display at least portions of each of them so that they can be selected and retrieved with minimal effort. It will be understood that the disclosed organizer is conveniently held in one hand due to its size, configuration, and simple folder-like construction. At the same time while the organizer is held open with one hand, the take-out menus 41 while still in the pockets 42 can be picked through or otherwise examined to quickly identify a menu of interest and to retrieve the same from the pocket for more detailed inspection. The organizer 10, due to its disclosed general size and folder configuration is easily stored in a kitchen drawer or other available storage area such as a cabinet where it will readily fit in an unobtrusive manner.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An organizer for take-out menus comprising a folder with two rectangular leafs that are generally mirror images of one another and that are similar in height and width, and a pair of rectangular inserts, the leafs each having outer, middle and inner sheets, the outer sheets of the leafs being joined at a common fold line extending in the direction of the height of the leafs, the leafs when folded together each having its outer sheet exposed and its inner sheet in contact with the inner sheet of the other leaf, the outer and middle sheets of each leaf being joined at three edges of the middle sheet and being free of interconnection at a vertical edge of the middle sheet immediately adjacent the common fold line thereby forming a large pocket that is substantially the same size in width and height as the width and height of the leafs, a rectangular insert panel positioned in each of the large pockets, the panels being substantially the same size as the size of the large pockets, the inner sheet and middle sheet of each leaf being joined at three edges of the inner sheet and being free of interconnection at a horizontal edge perpendicular to the common fold line of the inner sheet situated at about mid-height of a leaf thereby forming a shallow pocket adjacent a lower portion of the leaf with a depth equal to about one-half the height of a leaf, the shallow pockets each being adapted to receive and display a plurality of take-outs menus, said insert panels being sufficiently thick to add rigidity to their respective leafs.

2. An organizer as set forth in claim 1, wherein said sheets are vinyl.

3. An organizer as set forth in claim 2, wherein the inner sheets of said leafs are transparent so that portions of menus are visible through said inner sheets.

4. An organizer as set forth in claim 3, wherein the leafs are of a size that is conveniently held in one hand.

* * * * *